US012410953B2

(12) United States Patent
Low

(10) Patent No.: US 12,410,953 B2
(45) Date of Patent: Sep. 9, 2025

(54) CONDENSING UNIT

(71) Applicant: WKL GREEN ENERGY SDN BHD, Selangor (MY)

(72) Inventor: Wai Koon Low, Petaling Jaya (MY)

(73) Assignee: WKL ECO EARTH HOLDINGS PTE. LTD., Singapore (SG)

( * ) Notice: Subject to any disclaimer, the term of this patent is extended or adjusted under 35 U.S.C. 154(b) by 40 days.

(21) Appl. No.: 18/258,525

(22) PCT Filed: Dec. 14, 2021

(86) PCT No.: PCT/MY2021/050119
§ 371 (c)(1),
(2) Date: Jun. 20, 2023

(87) PCT Pub. No.: WO2022/139572
PCT Pub. Date: Jun. 30, 2022

(65) Prior Publication Data

US 2024/0302084 A1 Sep. 12, 2024

(30) Foreign Application Priority Data

Dec. 23, 2020 (MY) ..... PI2020006990

(51) Int. Cl.
*F25B 39/00* (2006.01)
*F25B 39/04* (2006.01)

(52) U.S. Cl.
CPC ..... *F25B 39/00* (2013.01); *F25B 39/04* (2013.01); *F25B 2339/041* (2013.01)

(58) Field of Classification Search
CPC ..... F24F 5/0017; F24F 1/42; F24F 13/222; F24F 5/00; F24F 5/0035; F24F 8/20;
(Continued)

(56) References Cited

U.S. PATENT DOCUMENTS 2,091,353 A * 8/1937 Downs ..... F24F 3/1417 95/91
4,107,942 A 8/1978 Fairman
(Continued)

FOREIGN PATENT DOCUMENTS

CN 110285518 A * 9/2019
CN 110307613 A * 10/2019
(Continued)

OTHER PUBLICATIONS

Pdf is original document of foreign reference WO9837372A1 (Year: 1998).*

(Continued)

*Primary Examiner* — Len Tran
*Assistant Examiner* — Kamran Tavakoldavani
(74) *Attorney, Agent, or Firm* — LOZA & LOZA, LLP; Michael Fedrick

(57) ABSTRACT

The present invention relates to a condensing unit (100) comprising an air outlet (110); at least one porous side wall (120); a compressor (140) operatively connected to a chamber (200), an expansion valve (500) and an evaporator coil (310) through a plurality of refrigerant lines (700); a water reservoir (150); a centrifugal fan (170); and at least one evaporative pad (130). A water pump (160) is configured to deliver water contained in the water reservoir (150) to the at least one evaporative pad (130) through at least one conduit (10), wherein a portion of the conduit (10*a*) extends within the chamber (200). The centrifugal fan (170) is configured to draw ambient air through the at least one evaporative pad (130) from the at least one porous side wall (120) of the condensing unit (100) so as to cool the water flowing down the evaporative pad (130).

17 Claims, 10 Drawing Sheets

(58) Field of Classification Search
CPC ..... F24F 2005/0025; F25B 39/00; F25B 1/00; F25B 2339/041; F25B 2339/047; F25B 39/04
See application file for complete search history.

(56) References Cited

U.S. PATENT DOCUMENTS

| | | | | |
|---|---|---|---|---|
| 2014/0174116 | A1 | 6/2014 | Habeebullah | |
| 2015/0204588 | A1* | 7/2015 | Lundgreen | F24F 1/0007 62/310 |
| 2017/0276382 | A1* | 9/2017 | Alazazmeh | F25B 39/00 |
| 2019/0128560 | A1* | 5/2019 | Frederick | F24F 13/222 |
| 2019/0316793 | A1* | 10/2019 | Ho | F24F 13/222 |
| 2020/0011550 | A1* | 1/2020 | Williams | F24F 1/022 |
| 2020/0025396 | A1* | 1/2020 | Leon | F25B 30/02 |
| 2020/0208887 | A1* | 7/2020 | Mohammad | F25B 39/04 |
| 2020/0363082 | A1 | 11/2020 | Low | |

FOREIGN PATENT DOCUMENTS

| | | | | |
|---|---|---|---|---|
| KR | 10-0266105 | | 9/2000 | |
| WO | WO-9837372 | A1 * | 8/1998 | F24F 5/0007 |
| WO | WO-2013077303 | A1 * | 5/2013 | A61L 9/14 |
| WO | 2020-246871 | | 12/2020 | |

OTHER PUBLICATIONS

Pdf is translation of foreign reference CN110285518A (Year: 2019).*
Pdf is original document of foreign reference Aizawa (Year: 2013).*
Pdf is translation of foreign reference CN 110307613 A (Year: 2019).*
International Search Report for corresponding International Patent Application No. PCT/MY2021/050119, dated Apr. 4, 2022.
International Written Opinion for corresponding International Patent Application No. PCT/MY2021/050119, dated Apr. 4, 2022.

* cited by examiner

CONDENSING UNIT

CROSS-REFERENCE TO RELATED APPLICATIONS

This application is the U.S. national stage of International Patent Application No. PCT/MY2021/050119, filed on Dec. 14, 2021 and entitled CONDENSING UNIT, which claims the benefit of priority under 35 U.S.C. § 119 from Malaysian Patent Application No. PI2020006990, filed Dec. 23, 2020. The disclosures of the foregoing applications are incorporated herein by reference in their entireties.

FIELD OF INVENTION

The present invention relates to a condensing unit adapted for use in heating, ventilating, and air conditioning (HAVC) and refrigeration systems; and more particularly an environmentally-friendly condensing unit which is capable of reducing temperature of waste heat being released into the environment.

BACKGROUND OF INVENTION

Heating, ventilating, and air conditioning (HAVC) system such as air conditioning system and chiller system are widely used to cool a designated area so as to achieve a comfortable indoor temperature while refrigeration system such as cool room are used to generate a specific temperature so as to preserve goods, particularly those that are perishable. It should be noted that while being able to provide the desirous cooling effect or desired temperature, a significant amount of waste heat is also being discharged into the outdoor environment by the condensing unit of HVAC or refrigeration systems. The discharged waste heat could raise the outdoor temperature which adds to the severity of urban heat islands. It should be noted that higher or warmer outdoor temperature would eventually lead to increased air conditioning demand which resulting in a positive feedback loop.

Further, condensate water produced by the evaporator or cooling coil of HVAC and refrigeration systems is typically drained into the environment and not being utilised, thereby causing wastage of free water source.

In addition, a typical condensing unit of HVAC and refrigeration systems does not have the functionality to introduce disinfectant into surrounding environment for disinfection purposes. Consequently, users are required to utilise other resources and/or equipment to carry out disinfection when needed by which this is time consuming and results in the incurrence of additional expenditure.

In view of these and other shortcomings, it is desirous to provide a condensing unit which is capable of reducing temperature of waste heat being discharged into the outdoor environment during its operation. It is also another objective of the present invention to provide a condensing unit which is utilising cold condensate water as an additional cooling medium and water source during its operation. It is also a further objective of the present invention to provide a condensing unit that is capable of introducing disinfectant into surrounding environment for disinfection purposes.

The condensing unit according to the preferred embodiments of the present invention and its combination of elements or parts thereof will be described and/or exemplified in the detailed description.

SUMMARY OF THE INVENTION

The present invention relates generally to a condensing unit adapted for use in heating, ventilating, and air conditioning (HAVC) and refrigeration systems. According to the preferred embodiments of the present invention, the condensing unit comprises an air outlet, at least one porous side wall, a compressor, a water reservoir for containing water, a centrifugal fan and at least one evaporative pad. In the preferred embodiments of the present invention, the compressor is operatively connected to a chamber, an expansion valve and an evaporator coil through a plurality of refrigerant lines. It should be noted that the chamber of the present invention is designed to replace existing condensing coil and is configured to receive the hot compressed refrigerant discharged from the compressor. Preferably, the compressor and the chamber are mounted on a supporting platform centrally located in the condensing unit. Alternatively, the compressor and the chamber can be housed in a separate compartment being contained within the condensing unit or located outside of the condensing unit. If desired, the compressor can be housed within the condensing unit while the chamber is located outside of the condensing unit or vice versa.

In the preferred embodiments of the present invention, the condensing unit is provided with a water pump. The water pump is configured to deliver and supply water contained in the water reservoir to the at least one evaporative pad through at least one conduit. According the preferred embodiments, a portion of the conduit is configured to extend within the chamber. It will be appreciated that the water flowing through the portion of the conduit located within the chamber will absorb heat from the hot compressed refrigerant during operation of the condensing unit. It should be noted that the water, after absorbing heat in the chamber, is preferably delivered to the upper surface of the at least one evaporative pad such that the water flows down and wet the entire evaporative pad.

According to the preferred embodiments of the present invention, the at least one evaporative pad is preferably disposed above the water reservoir. Preferably, the at least one evaporative pad is suitably mounted proximate the at least one porous side wall of the condensing unit. In the preferred embodiments of the present invention, the centrifugal fan is suitably positioned proximate the air outlet of the condensing unit. It should be noted that the centrifugal fan is configured to draw ambient air from the at least one porous side wall of the condensing unit through the wetted evaporative pad. It will be appreciated that the drawn air remove heat from the wetted evaporative pad when the air travels through the wetted evaporative pad. In accordance with the preferred embodiments of the present invention, the air that moves through the wetted evaporative pad is discharged through the air outlet of the condensing unit and excessive water from the wetted evaporative pad is cascaded back into the water reservoir.

In the preferred embodiments of the present invention, the condensate water formed from air condensation on the surface of the evaporator coil or cooling coil of the HVAC and refrigeration systems is drained into the water reservoir of the condensing unit through a condensate line. The condensate water is used as an additional cooling medium to cool the water contained in the water reservoir and also as an additional water source to replenish the volume of water in the water reservoir.

In accordance with the preferred embodiments of the present invention, the condensing unit is provided with a disinfectant dispenser operatively connected to a control unit. It should be noted that the control unit is configured to regulate the activation and deactivation of the disinfectant dispenser. Preferably, the disinfectant dispenser is disposed above the water reservoir. According to the preferred embodiments of the present invention, the disinfectant dispenser is configured to dispense a predetermined amount of disinfectant into the water reservoir. In one preferred embodiment of the present invention, the water contained in the reservoir, after mixed with the disinfectant, is preferably delivered to the upper surface of the at least one evaporative pad through the at least one conduit such that the disinfectant containing water flows down and wet the entire evaporative pad. It will be appreciated that when the centrifugal fan draws the ambient air from the at least one porous side wall of the condensing unit through the wetted evaporative pad, the disinfectant containing water is vapourised and the same is discharged into the surrounding area through the air outlet of the condensing unit.

In another preferred embodiment of the present invention, the disinfecting containing water is preferably delivered to a dispensing unit preferably mounted proximate the air outlet of the condensing unit by means of at least one pipeline. Preferably, the pipeline is an independent pipeline operatively connected to a second water pump. If desired, the pipeline can be a branch pipeline of the conduit. In this preferred embodiment, the disinfectant containing water is discharged to the surrounding area through the air outlet of the condensing unit when the control unit is activated.

As an alternative to the disinfectant dispenser as described above, a spray dispenser pre-filled with disinfection aerosol could be provided. The spray dispenser is preferably mounted proximate the air outlet of the condensing unit and operatively connected to the control unit. It should be noted that a predetermined amount of disinfection aerosol is discharged to the surrounding area through the air outlet of the condensing unit when the control unit is activated.

If desired, the condensing unit may be further provided with a reversing valve operatively connected to the refrigerant lines. It should be noted that the reversing valve is configured to enable the HVAC system to change from cooling operation to heating operation or vice versa.

In the preferred embodiments of the present invention, the condensing unit may be further provided with a plurality of wheels mounted on a base surface of the condensing unit for portability.

The condensing unit according to the preferred embodiments of the present invention and its combination of elements and parts thereof will be described and/or exemplified in the detailed description.

The present invention consists of several novel features and a combination of parts hereinafter fully described and illustrated in the accompanying description and drawings, it being understood that various changes in the details may be made without departing from the scope of the invention or sacrificing any of the advantages of the present invention.

BRIEF DESCRIPTION OF THE DRAWINGS

The present invention will be fully understood from the detailed description given herein below and the accompanying drawings which are given by way of illustration only, and thus are not limitative of the present invention, wherein.

DETAILED DESCRIPTION OF THE PREFERRED EMBODIMENTS

Figure 1:
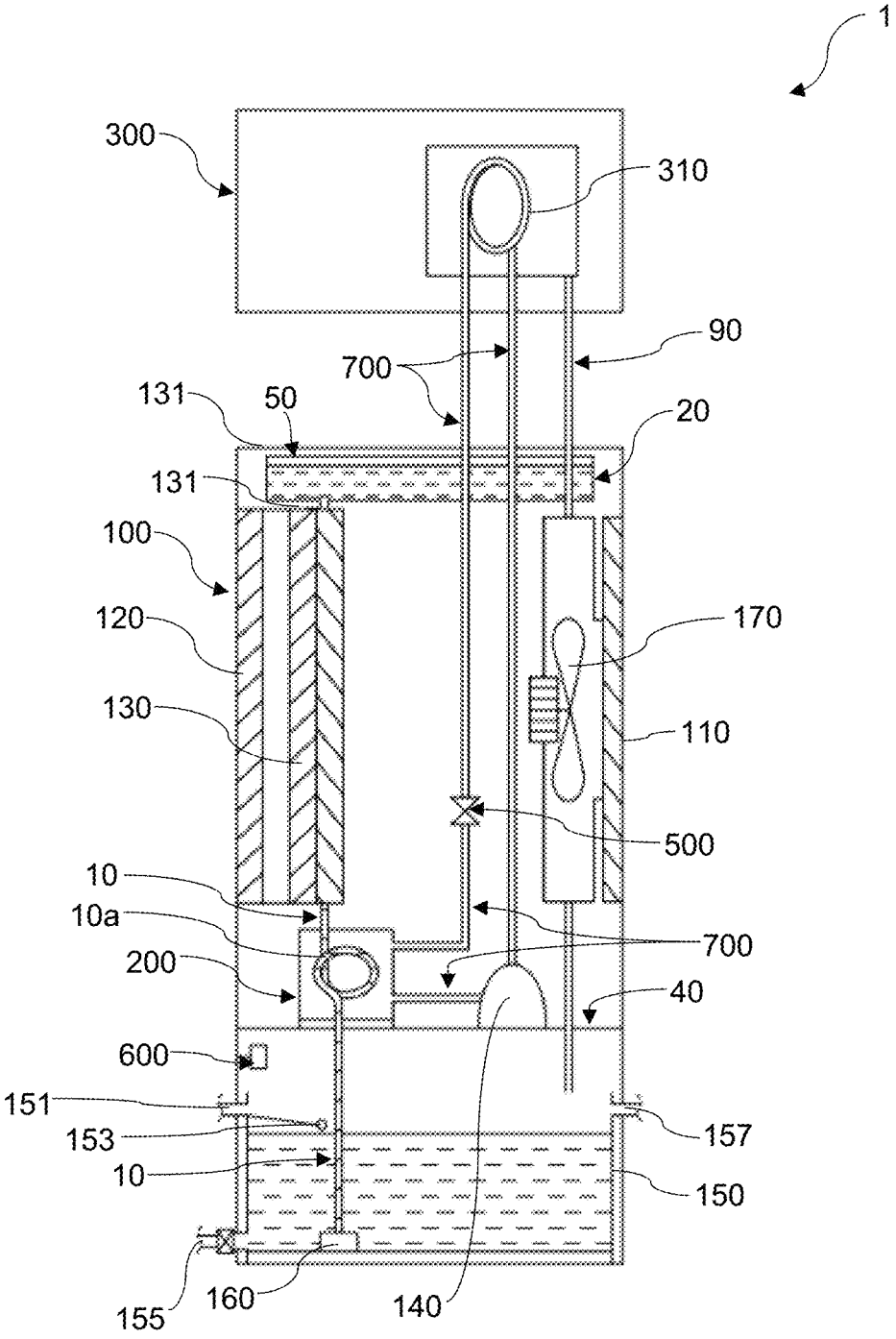
FIG. 1 illustrates a side view of a condensing unit provided with a water receiving tray adapted for use in HVAC and refrigeration systems in accordance with the preferred embodiments of the present invention.

The present invention relates to a condensing unit adapted for use in heating, ventilating, and air conditioning (HAVC) and refrigeration systems. More particularly, an environmentally-friendly condensing unit which is capable of reducing temperature of waste heat being released into the environment during its operation. Hereinafter, this specification will describe the present invention according to the preferred embodiments of the present invention. However, it is to be understood that limiting the description to the preferred embodiments of the invention is merely to facilitate discussion of the present invention and it is envisioned that those skilled in the art may devise various modifications and equivalents without departing from the scope of the appended claims.

In the description of embodiments disclosed herein, any reference to direction or orientation is merely intended for convenience of description and is not intended in any way to limit the scope of the present invention. Relative terms such as "upper" and "top" as well as derivative thereof should be construed to refer to the orientation as then described or as shown in the drawings under discussion. These relative terms are for convenience of description only and do not require that the apparatus be constructed or operated in a particular orientation.

The condensing unit according to the preferred embodiments of the present invention will now be described in accordance with the accompanying drawings FIGS. 1 to 9*b*, either individually or in any combination thereof. Referring to FIGS. 1 to 9*b*, preferred embodiments of a condensing unit 100 adapted for use in HVAC and refrigerant systems 1 in accordance with the present invention are depicted. It should be noted that certain elements or parts of the condensing unit 100 of the present invention are common to the depicted embodiments and are commonly numbered in FIGS. 1 to 9*b*.

Figure 2:
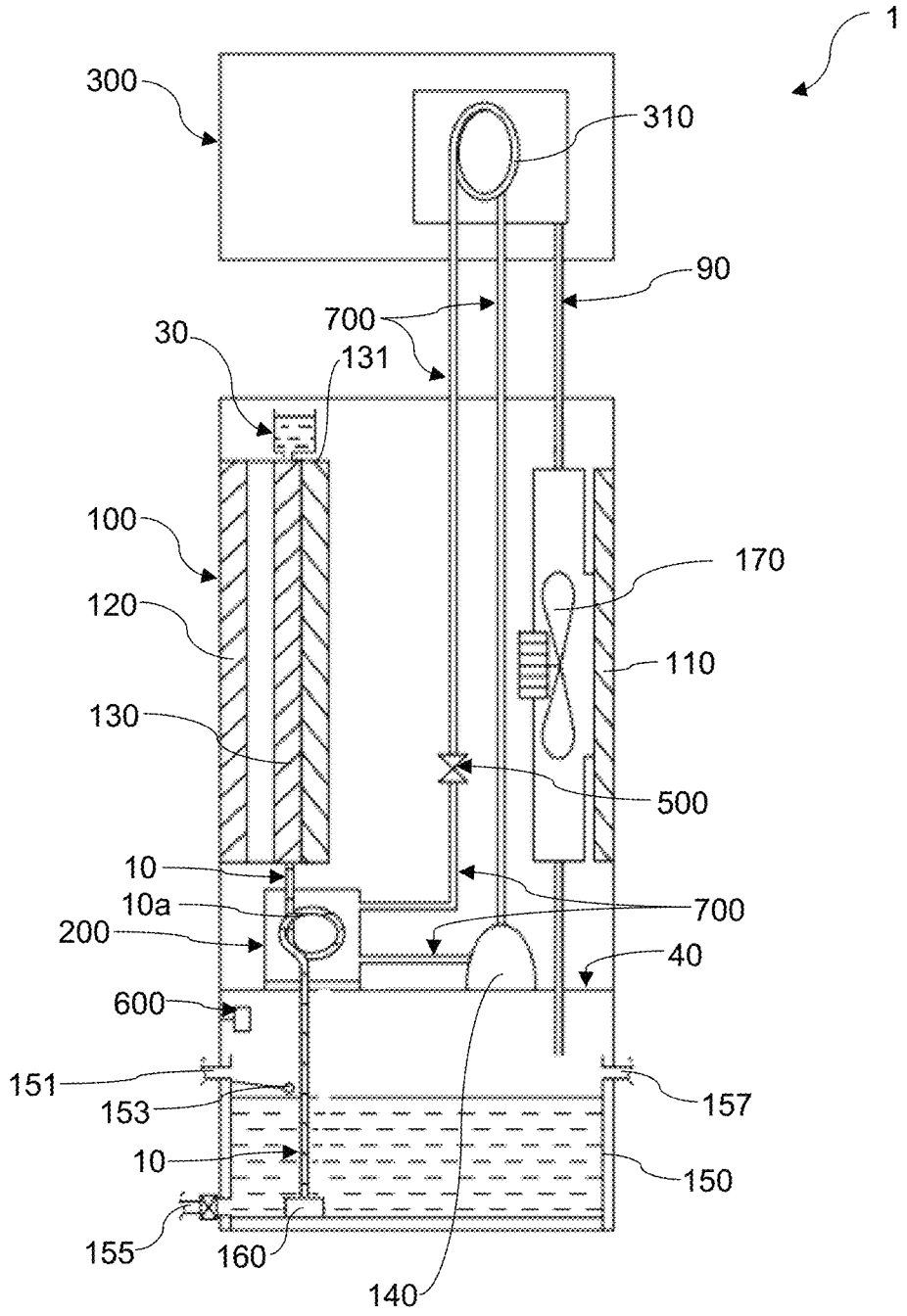
FIG. 2 illustrates a side view of a condensing unit provided with a trough adapted for use in HVAC and refrigerant systems in accordance with the preferred embodiments of the present invention.
Figure 3:
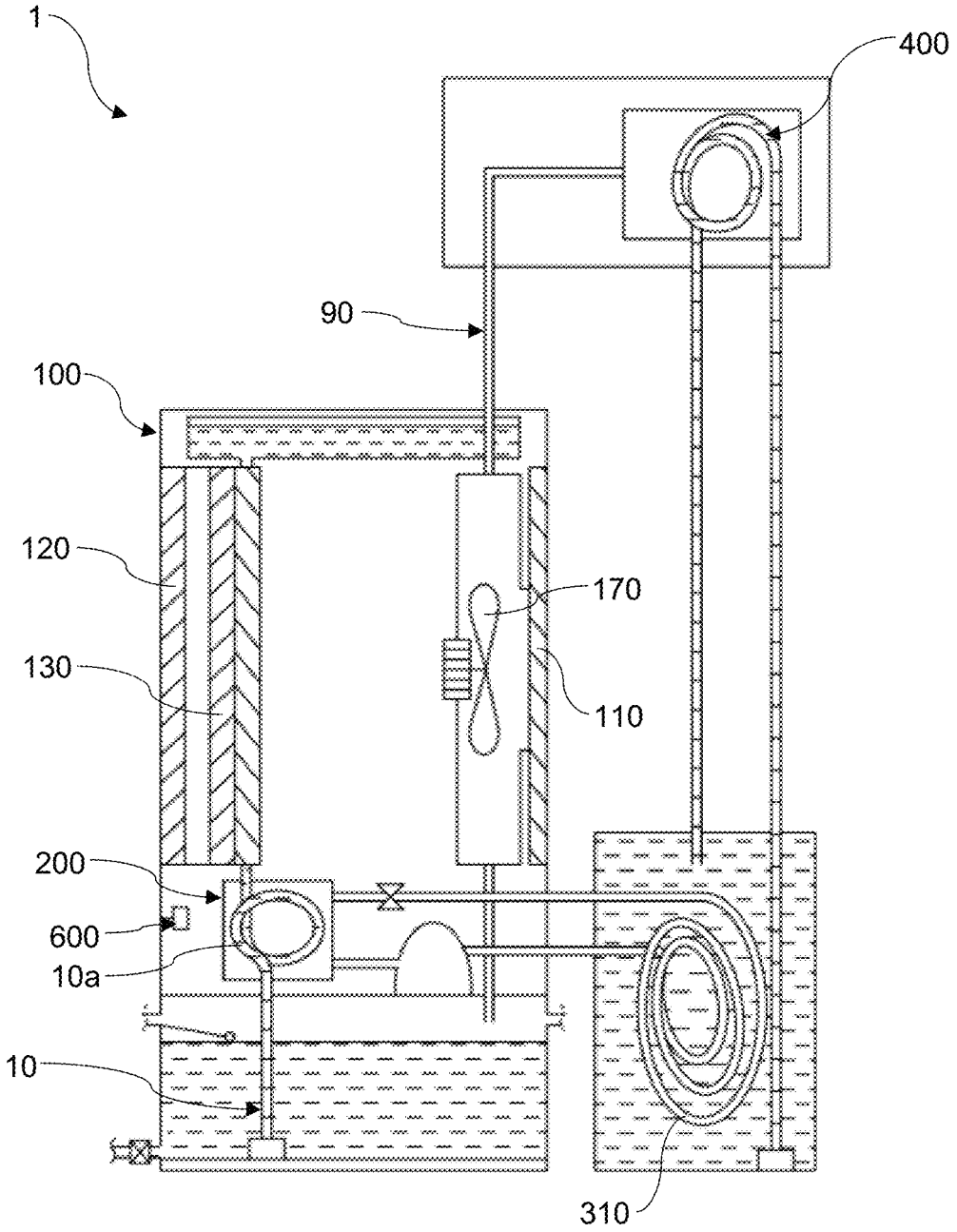
FIG. 3 illustrates a side view of a condensing unit of the present invention adapted for use in conjunction with a chiller of HVAC system.

The condensing unit 100 of the preferred embodiments of the present invention comprising an air outlet 110, at least one porous side wall 120, a compressor 140, a water reservoir 150 for containing water, a centrifugal fan 170 and at least one evaporative pad 130. It should be noted that the condensing unit 100 of the present invention is adapted to be operatively connected to any known evaporators in the HVAC and refrigeration systems. By way of example but not limitation, the condensing unit of the present invention can be operatively connected to an evaporator of an air conditioning system as illustrated in FIGS. 1 and 2, an evaporator of a chiller system as illustrated in FIG. 3 or an evaporator of a cool room system.

Figure 4:
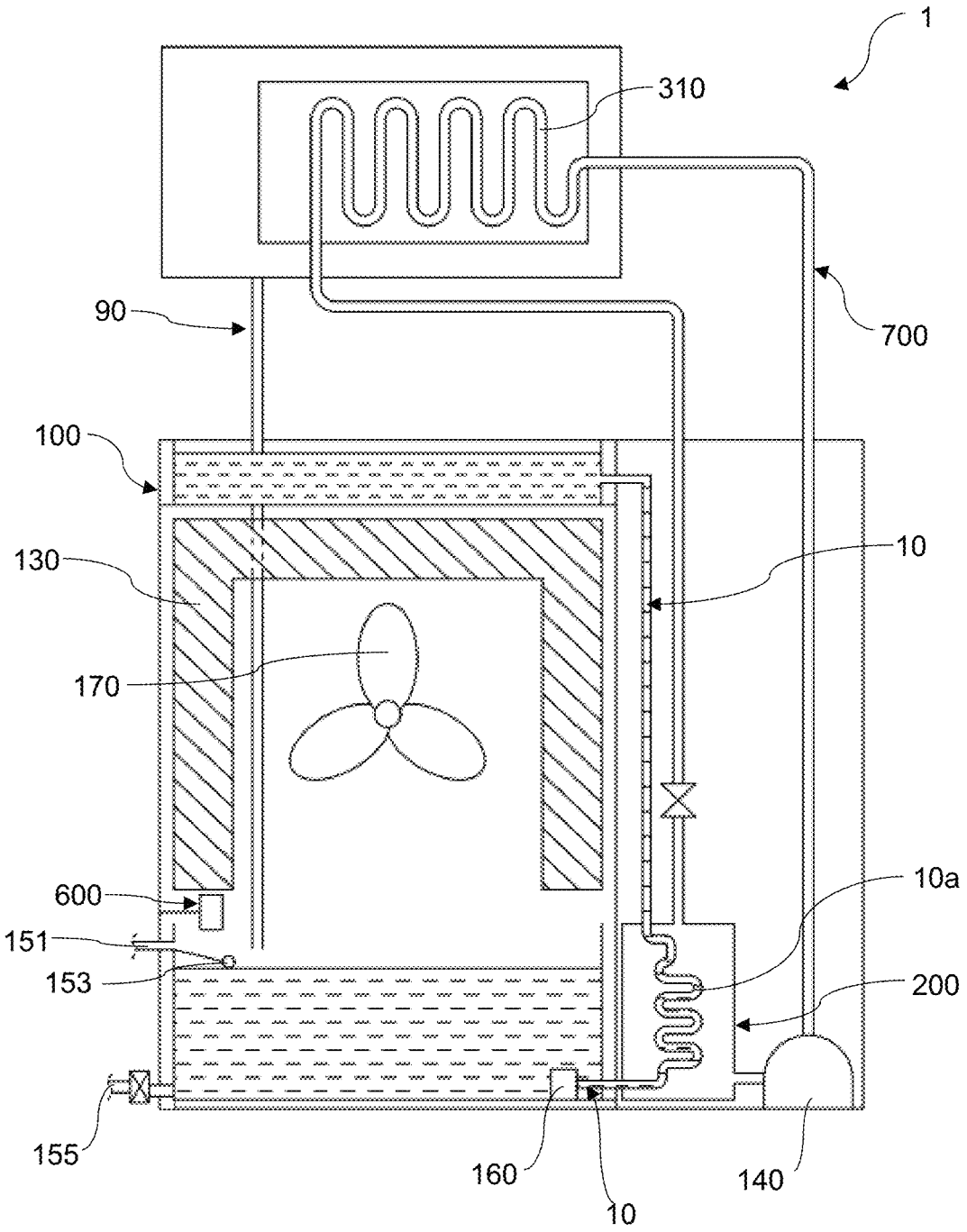
FIG. 4 illustrates a front view of a condensing unit of the present invention provided with a separate compartment to house a compressor and a chamber of the condensing unit.

According to the preferred embodiments of the present invention, the compressor 140 of the condensing unit 100 is operatively connected to a chamber 200, an expansion valve 500 and an evaporator coil 310 of an evaporator 300 through a plurality of refrigerant lines 700 and formed a closed circuit. Preferably, the closed circuit is filled with refrigerant. It should be noted that the chamber 200 of the present invention is designed to replace existing condensing coil. According to the preferred embodiments of the present invention, the chamber 200 is configured to receive the hot compressed refrigerant discharged from the compressor 140. It will be appreciated that the chamber 200 is configured in such a manner so as to improve heat transfer performance. By way of example but not limitation, the chamber 200 is preferably having a spherical-shape. However, it should also be readily apparent that the chamber 200 can come in a variety of shapes. In the preferred embodiments of the present invention, the compressor 140 and the chamber 200 are preferably mounted on a supporting platform 40. Preferably, the supporting platform 40 is centrally located in the condensing unit 100 as illustrated in FIGS. 1, 2, 3, 5*a*, 5*b*, 6 and 7. Alternatively, the compressor 140 and the chamber 200 can be housed in a separate compartment being contained within the condensing unit 100 or located outside of the condensing unit 100 as illustrated in FIG. 4. If desired, the compressor 140 can be housed within the condensing unit 100 while the chamber 200 is located outside of the condensing unit 100 or vice versa.

According to the preferred embodiments of the present invention, a water pump 160 is configured to deliver and supply water contained in the water reservoir 150 to the evaporative pad 130 by means of at least one conduit 10. It should be noted that the water pump 160 may be placed external to the water reservoir 150 or is a submersible type as illustrated in FIGS. 1 to 7. In the preferred embodiments of the present invention, a portion of the conduit 10, shown by reference number 10*a* extends within the chamber 200 as illustrated in FIGS. 1 to 7. It should be noted that the aforesaid configuration could significantly enhance heat exchanging efficiency between the water flowing through the conduit portion 10*a* and the hot refrigerant contained in the chamber 200 and thereby, intensifying the cooling effect of the chamber 200. It should be noted that the water flowing through the conduit portion 10*a* located within the chamber 200 will absorb heat from the hot compressed refrigerant in the chamber 200 and thereby, removing heat from the chamber 200 due to heat exchange. In the preferred embodiments of the present invention, the water flowing through the portion of the conduit 10*a* located within the chamber 200 will become warm after absorbing the heat from the hot refrigerant in the chamber 200 and the warm water is preferably delivered to the at least one evaporative pad 130. Preferably, the warm water is delivered to an upper surface 131 of the at least one evaporative pad 130 such that the water flows down and wet the at least one evaporative pad 130. It should be noted that the excessive water from the wetted evaporative pad 130 will be cascaded back into the water reservoir 150.

Preferably, the conduit portion 10*a* that located within the chamber 200 is arranged in the shape of a coil and can have either a vertical or horizontal orientation. By way of example but not limitation the conduit portion 10*a* that located within the chamber 200 can be arranged in the form of a helical coil or a spiral coil or the like. In an alternate embodiment, the conduit portion 10*a* that located within the chamber 200 is an independent coil having an inlet and outlet in fluid communication with the conduit 10.

In accordance with the preferred embodiments of the present invention, the water reservoir 150 is preferably sited below the at least one evaporative pad 130 as illustrated in FIGS. 1 to 7. It should be noted that the water reservoir 150 should be filled with sufficient water before the condensing unit 100 is put into operation. If desired, the top of the water reservoir 150 may be covered by a non-corrosive removable mesh screen to prevent dirt or small organisms such as insects from entering the water reservoir 150. The removable mesh screen may be formed of plastic, aluminium, or any other suitable lightweight non-corrosive material. In the preferred embodiments of the present invention, water is supplied into the water reservoir 150 through a water inlet 151 connected to a float valve 153 as illustrated in FIGS. 1 to 7. The float valve 153 is configured to control water flow so as to replenish and maintain the water level of the water reservoir 150 during operation of the condensing unit 100.

According to the preferred embodiments of the present invention, the water reservoir 150 of the condensing unit 100 is provided with an overflow pipe 157. Preferably, the overflow pipe 157 is located proximate the top of the water reservoir 150 as illustrated in FIGS. 1, 2, 3, 5*a*, 5*b*, 6 and 7. It should be noted that the overflow pipe 157 is configured to allow surplus water to be discharged from the water reservoir 150 in the event of malfunctioning of the float valve 153.

In the preferred embodiments of the present invention, the water reservoir 150 of the condensing unit 100 is provided with a drain pipe 155. Preferably, the drain pipe 155 is located proximate the bottom of the water reservoir 150 as illustrated in FIGS. 1 to 7. It should be noted that the drain pipe 155 is configured to drain water from the water reservoir 150 for maintenance or servicing of the condensing unit 100.

According to the preferred embodiments of the present invention, the centrifugal fan 170 is preferably deposited at the central portion of the condensing unit 100 and suitably positioned proximate the air outlet 110 of the condensing unit 100 as illustrated in FIGS. 1 to 7.

In the preferred embodiments of the present invention, the at least one evaporative pad 130 is preferably mounted proximate the at least one porous side wall 120 of the condensing unit 100 as illustrated in FIG. 1. It should be noted that the at least one evaporative pad 130 is preferably having dimensions sufficient to conceal the at least one porous side wall 120 of the condensing unit 100. In the present invention, it is preferred that the number of evaporative pads 130 correspond to the number of porous side walls 120 of the condensing unit 100. Preferably, the condensing unit 100 of the preferred embodiments of the present invention is provided with three porous side walls 120 and each of the three porous side walls 120 is concealed by the evaporative pad 130.

Alternatively, the at least one evaporative pad 130 can be disposed at the center of the condensing unit 100, either in a horizontal position or a vertical position. In the embodiment of the condensing unit is provided with the at least one evaporative pad 130 disposed horizontally at the center of the condensing unit, the air outlet is preferably sited at a top surface 180 of the condensing unit. In this embodiment, the centrifugal fan 170 is preferably deposited above the at least one evaporative pad 130 and suitably positioned proximate the air outlet 110 of the condensing unit 100.

Figure 8:
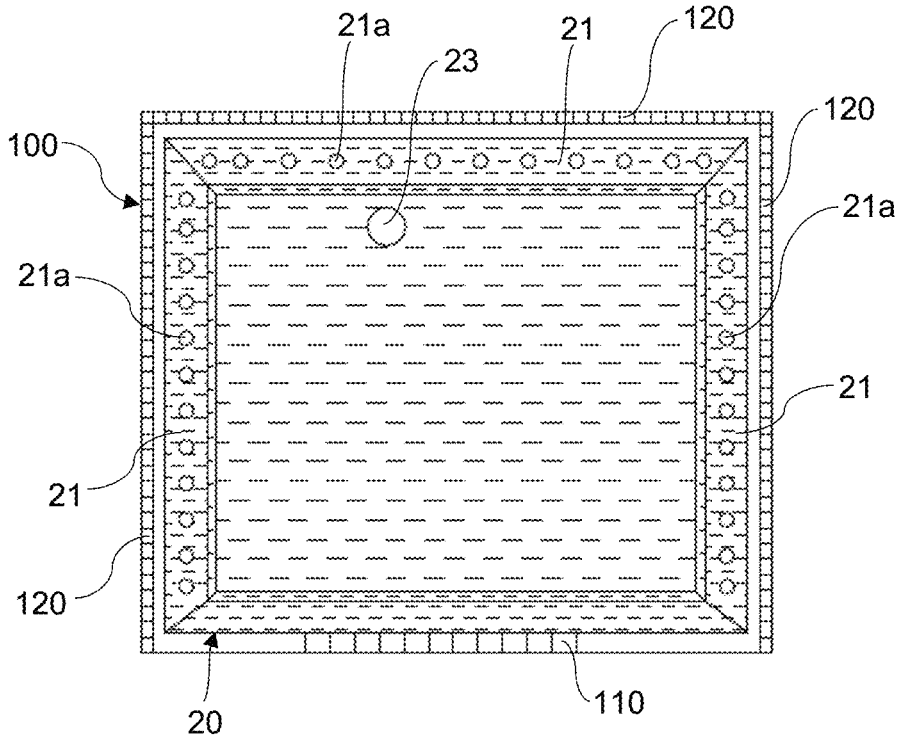
FIG. 8 illustrates a top view of the condensing unit as showed in FIGS. 1 and 3.
Figure 9A:
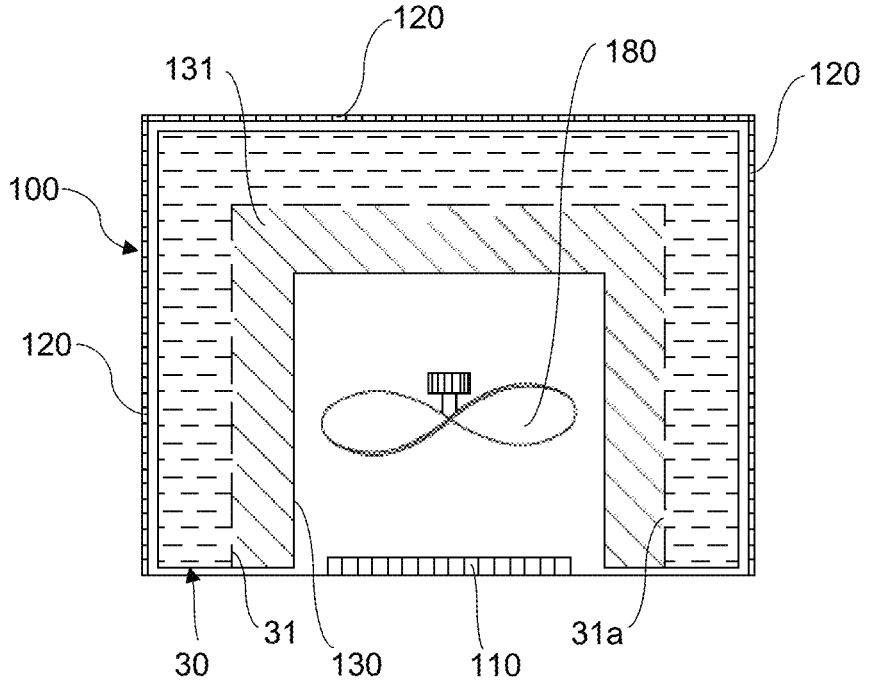
FIGS. 9*a* and 9*b* illustrate a top view of the condensing unit as showed in FIG. 2 showing different embodiments of trough of the condensing unit of the present invention.
Figure 9B:
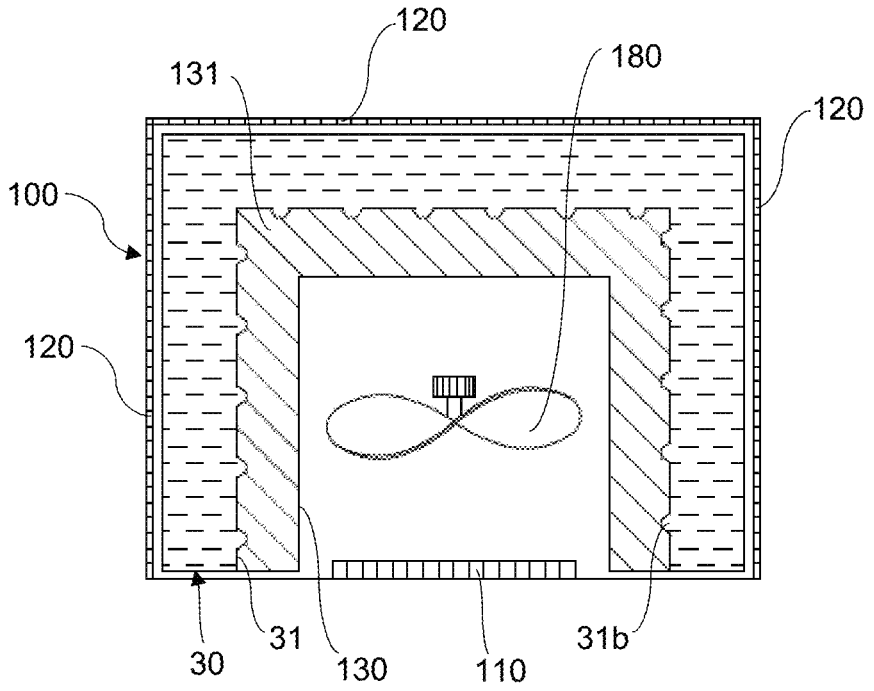

In the preferred embodiments of the present invention, the condensing unit 100 may be provided with a water receiving tray 20 as illustrated in FIGS. 1 and 8 or a trough 30 as illustrated in FIGS. 2, 9*a* and 9*b*. In the embodiment of the condensing unit 100 is provided with the water receiving tray 20, the water receiving tray 20 is suitably mounted on top of the condensing unit 100. Preferably, the water receiving tray 20 is having a recessed channel 21 formed along the water receiving tray perimeter. In this preferred embodiment, the recessed channel 21 situated above the evaporative pad 130 is provided with a plurality of spaced apart apertures 21*a* as illustrated in FIG. 8. In this preferred embodiment, the water receiving tray 20 is in fluid communication with the at least one conduit 10. By way of example but not limitation, the at least one conduit 10 may either integrally form with the water receiving tray 20 or affix to an opening 23 of the water receiving tray 20 through interference fit or application of suitable adhesives. In this preferred embodiment, the water in the water receiving tray 20 will be uniformly and continuously dispensed onto the upper surface 131 of the evaporative pad 130 through the plurality of apertures 21*a* formed at the base of the recessed channel 21. By way of example but not limitation, the recessed channel 21 of the water receiving tray 20 may be U-shaped or V-shaped in section. In this preferred embodiment, a lid 50 may be provided to cover the water receiving tray 20 so as to prevent dirt or small organisms such as insects from entering the water receiving tray 20 as illustrated in FIG. 1. The lid 50 may be formed of plastic, aluminium, or any other suitable lightweight non-corrosive material.

In the embodiment of the condensing unit 100 is provided with the trough 30, the trough 30 is suitably positioned above the at least one evaporative pad 130 and is in fluid communication with the at least one conduit 10. By way of example but not limitation, the at least one conduit 10 may either integrally form with the trough 30 or affix to an opening of the trough 30 through interference fit or application of suitable adhesives. Preferably, the trough 30 only covers a portion of the upper surface 131 of the evaporative pad 130 as illustrated in FIG. 2 so as to allow the water to be directly distributed over the upper surface 131 of the evaporative pad 130. In this preferred embodiment, the trough 30 may be provided with a plurality of spaced apart indentations 31*a* preferably formed on at least one side wall 31 of the trough 30 as illustrated in FIG. 9*a*. It should be noted that the plurality of indentations 31*a* of the trough 30 are configured to allow the water to flow uniformly out of the trough 30 such that the water is continuously distributed over the upper surface 131 of the evaporative pad 130. Alternatively, the trough 30 may be provided with a plurality of protruding lips 31*b* formed integral with and extend outwardly from the at least one side wall 31 of the trough 30 as illustrated in FIG. 9*b*. It should be noted that the plurality of protruding lips 31*b* of the trough 30 are configured to guide and direct the flow of water onto the upper surface 131 of the evaporative pad 130 in a continuous and uniform manner. If desired, a cover (not shown) may be provided to cover the trough 30 so as to prevent dirt or small organisms such as insects from entering the trough 30. The lid may be formed of plastic, aluminium, or any other suitable lightweight non-corrosive material.

In each of the preferred embodiments of the present invention, ambient air from the surrounding is drawn by the centrifugal fan 170 from the at least one porous side wall 120 and travelled through the at least one evaporative pad 130. It will be appreciated that the drawn air cools the water flowing down the at least one evaporative pad 130 through heat transfer. It should be noted that the at least one evaporative pad 130 must have a sufficient thickness so as to allow efficient heat exchange. By way of example but not limitation, the thickness of the evaporative pad 130 is preferably in the range of 1 inch to 5 inches in order to achieve the desirous heat transfer efficiency for domestic HVAC and refrigeration systems while for commercial HVAC and refrigeration systems, the thickness of the evaporative pad 130 is preferably in the range of 5 inches to 32 inches. However, it should also be readily apparent that the thickness of the evaporative pad 130 can be a variety of thicknesses and the thickness may vary depending on the materials of the evaporative pad 130 used in the condensing unit 100.

In the preferred embodiments of the present invention, the evaporative pad 130 is preferably honeycomb cooling pad. Preferably, the honeycomb cooling pad is made of cellulose. However, it should be readily apparent that the evaporative pad 130 may be a multilayer fiber pad or a wood wool pad or corrugated cardboard or the like.

In the preferred embodiments of the present invention, the drawn air is discharged through the air outlet 110 of the condensing unit 100. It will be appreciated that the temperature of the air discharged from the air outlet 110 of the condensing unit 100 of the present invention is in the range of about 22° C. to 30° C. which is significantly lower than the temperature (50° C. to 60° C.) of waste heat generated by a typical condenser in HVAC and refrigeration systems. More specifically, the temperature of the air discharged from the air outlet 110 of the condensing unit 100 of the present invention is in the range of about 24° C. to 30° C. during day time when the outdoor temperature is in the range of about 27° C. to 35° C. While at night, the temperature of the air discharged from the air outlet 110 of the condensing unit 100 of the present invention is in the range of about 22° C. to 27° C. when the outdoor temperature is in the range of about 23° C. to 30° C.

If desired, a filtering means may be detachably disposed at the porous side walls 120 of the condensing unit 100 so as to filter out dust, dirt, odors or other undesired substances carried in the air entering the condensing unit 100 and thereby, extending the life and efficiency of the evaporative pad 130. By way of example, the filtering means may include but not limited to carbon filter.

In accordance with the preferred embodiments of the present invention, condensate water formed on the surface of the evaporator coil 310 or cooling coil 400 of the HVAC and refrigeration systems 1 is preferably being channeled into the water reservoir 150 of the condensing unit 100 through a condensate line 90 as illustrated in FIGS. 1 to 7. It should be noted that aside from being used as an additional cooling medium to cool the water contained in the water reservoir 150, the condensate water is also used as an additional water source to replenish the volume of water contained in the water reservoir 150.

In accordance with the preferred embodiments of the present invention, the condensing unit 100 is provided with a disinfectant dispenser 600 as illustrated in FIGS. 1, 2, 3, 4, 5*a*, 5*b* and 7. It should be noted that the disinfectant dispenser 600 can be filled with any disinfectant deemed suitable for disinfection. According to the preferred embodiments of the present invention, the disinfectant dispenser 600 is operatively connected to a control unit (not shown) whereby the control unit is configured to regulate the activation and deactivation of the disinfectant dispenser 600. Preferably, the disinfectant dispenser 600 is disposed above the water reservoir 150 as illustrated in FIGS. 1, 2, 3, 4, 5*a*, 5*b* and 7. According to the preferred embodiments of the present invention, the disinfectant dispenser 600 is configured to dispense a predetermined amount of disinfectant into the water reservoir 150 when a function switch (not shown) of the control unit is actuated by a user. In one preferred embodiment of the present invention, the water contained in the water reservoir 150, after mixed with the disinfectant, is preferably delivered to the upper surface 131 of the at least one evaporative pad 130 through the at least one conduit 10 such that the disinfectant containing water flows down and wet the entire evaporative pad 130. In the embodiment of the condensing unit 100 is provided with the water tray 20 or trough 30, the disinfectant containing water is preferably delivered to the water tray 20 or trough 30 of the condensing unit 100 of the present invention for uniform distribution of the disinfectant containing water onto the evaporative pad 130. It will be appreciated that when the centrifugal fan 170 draws the ambient air from the at least one porous side wall 120 of the condensing unit 100 through the wetted evaporative pad 130, the disinfectant containing water is vapourised and the same is discharged into the surrounding area through the air outlet 110 of the condensing unit 100 and, thereby achieving the purpose of disinfection.

Figure 5A:
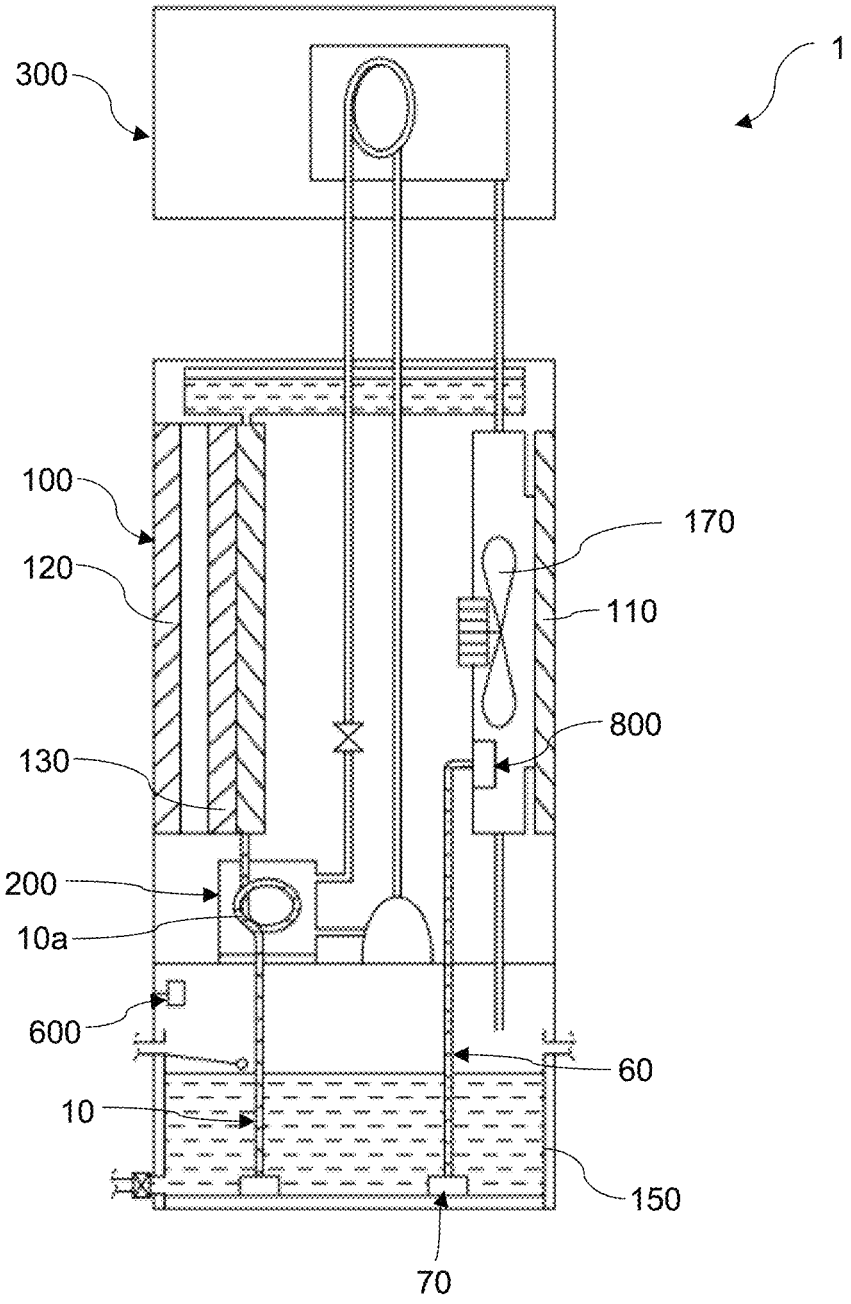
FIGS. 5*a* and 5*b* illustrate a side view of a condensing unit of the present invention provided with a dispensing unit adapted for dispensing disinfectant containing water.
Figure 5B:
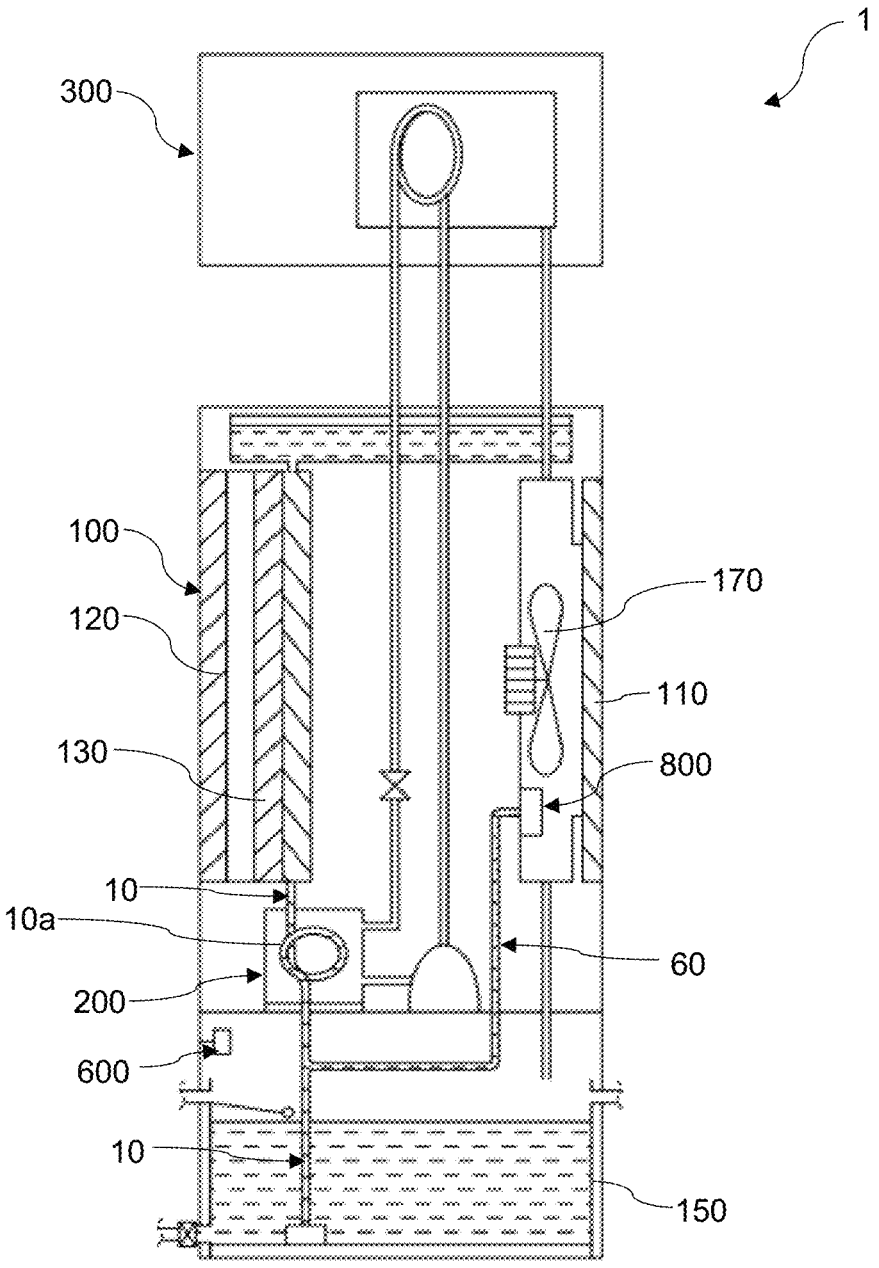

In another preferred embodiment of the present invention, the disinfecting containing water is preferably delivered to a dispensing unit 800 by means of at least one pipeline 60 as illustrated in FIGS. 5*a* and 5*b*. In this preferred embodiment, the dispensing unit 800 is preferably mounted proximate the air outlet 110 of the condensing unit 100. Preferably, the pipeline is an independent pipeline 60 operatively connected to a second water pump 70 as illustrated in FIG. 5*a*. If desired, the pipeline 60 can be a branch pipeline of the conduit 10 and the pipeline 60 is preferably branched out from the conduit 10 before the conduit portion 10*a* extends within the chamber 200 as illustrated in FIG. 5*b*. In this preferred embodiment, actuation of the function switch of the control unit will simultaneously activate the dispensing unit 800, to thereby discharge the disinfectant containing water into the surrounding environment through the air outlet 110 of the condensing unit 100. Preferably, the dispensing unit 800 is adapted for discharging the disinfectant containing water in the form of fog or mist.

Figure 6:
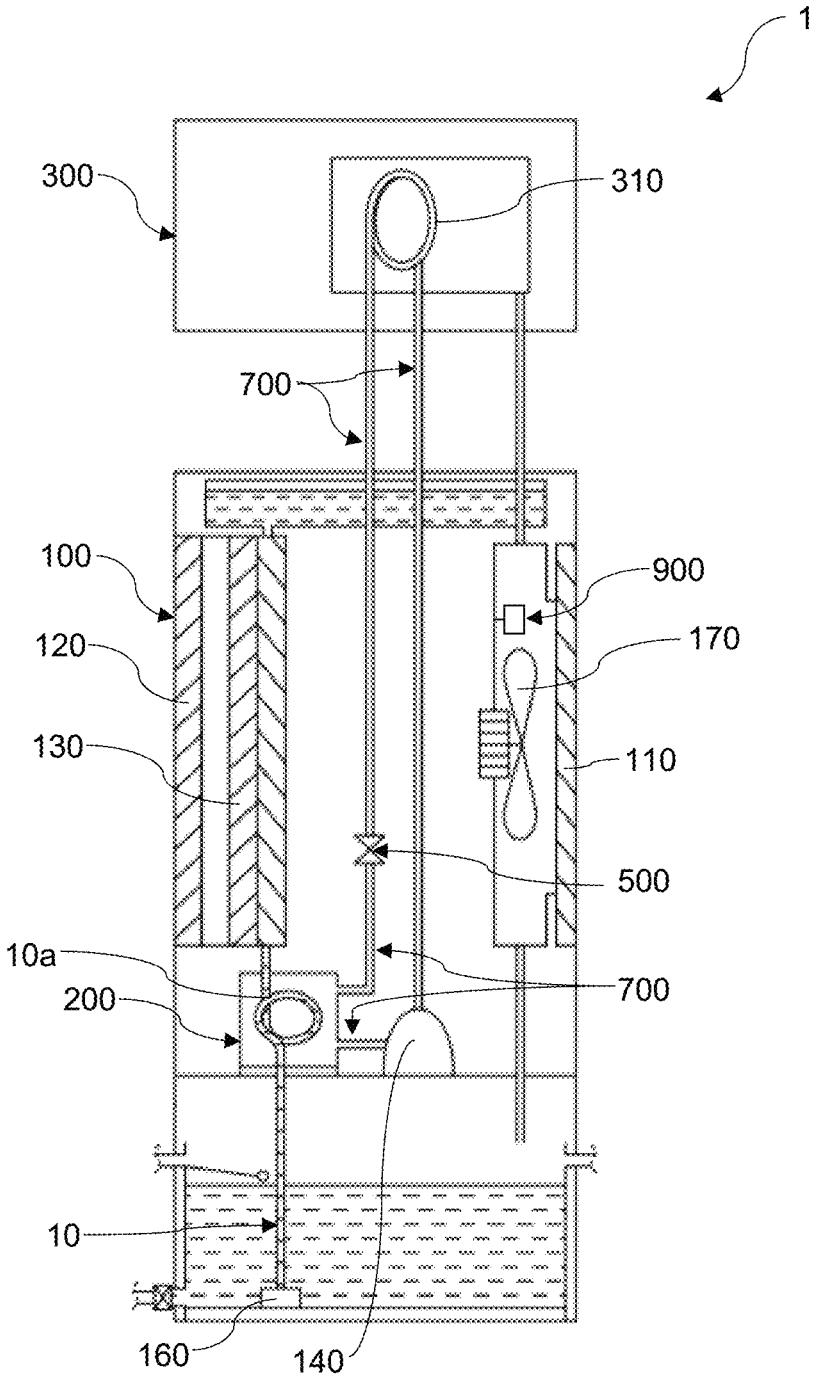
FIG. 6 illustrates a side view of a condensing unit of the present invention provided with a spray dispenser adapted for dispensing disinfection aerosol.

As an alternative to the disinfectant dispenser 600 as described above, a spray dispenser 900 pre-filled with disinfection aerosol could be provided. The spray dispenser 900 is preferably mounted proximate the air outlet 110 of the condensing unit 100 as illustrated in FIG. 6 and operatively connected to the control unit. The spray dispenser 900 is configured to dispense a predetermined amount of disinfection aerosol to the surrounding area through the air outlet 110 of the condensing unit 100 when the function switch (not shown) of the control unit is actuated by a user.

Figure 7:
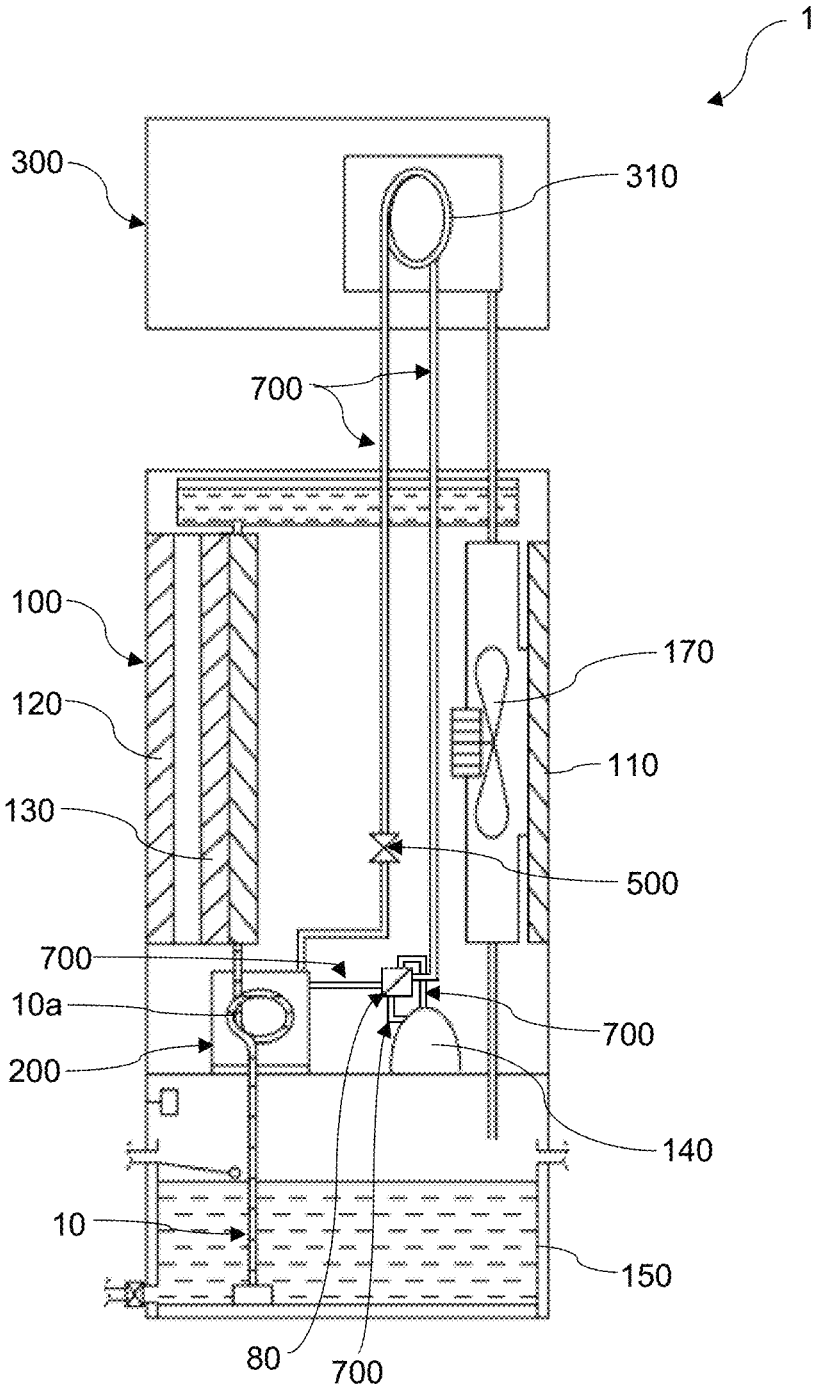
FIG. 7 illustrates a side view of a condensing unit of the present invention provided with a reversing valve.

If desired, the condensing unit 100 of the present invention may be further provided with a reversing valve 80 operatively connected to the refrigerant lines 700 as illustrated in FIG. 7. It should be noted that the reversing valve 80 is configured to change the flow direction of the refrigerant in the refrigerant lines 700 so as to enable the HVAC system to change from cooling operation to heating operation or vice versa, as desired by a user. It should be noted that during operation in the heating mode, the direction of the refrigerant flow is changed by the reversing valve 800 and the condensing unit 100 of the present invention becomes an evaporator while the evaporator 300 of the present invention acts as a condenser so as to introduce warm air to an indoor space.

According to each of the preferred embodiments of the present invention, the condensing unit 100 may be further provided with a plurality of wheels (not shown) for portability. Preferably, the plurality of wheels are mounted on a base surface of the condensing unit.

It should be noted that configurations of various parts, elements and/or members used to carry out the above-mentioned embodiments are illustrative and exemplary only. One of ordinary skill in the art would recognize that those configurations, parts, elements and/or members used herein may be altered in a manner so as to obtain different effects or desired operating characteristics. Other combinations and/or modifications of the above-described configurations, arrangements, structures, applications, functions or components used in the practice of the present invention, in addition to those not specifically recited, may be varied or otherwise particularly adapted to specific environments and conditions, manufacturing specifications, design parameters or other operating requirements without departing from the general principles of the same.

The invention being thus described, it will be obvious that the same may be varied in many ways. Such variations are not to be regarded as a departure from the principle and scope of the invention, and all such modifications as would obvious to one skilled in the art intended to be included within the scope of following claims.

The invention claimed is:

1. A condensing unit (100) adapted for use in heating, ventilation and air conditioning (HVAC) and refrigeration systems (1), wherein the condensing unit (100) comprises:

a compressor (140) operatively connected to a chamber (200), an expansion valve (500) and an evaporator coil (310) through a plurality of refrigerant lines (700);

a water pump (160) configured to deliver and supply water contained in a water reservoir (150) to at least one evaporative pad (130) through at least one conduit (10), wherein a portion of the conduit (10*a*) extends within the chamber (200);

a centrifugal fan (170) positioned proximate an air outlet (110), wherein the centrifugal fan (170) is configured to draw ambient air through the at least one evaporative pad (130) from at least one porous side wall (120) and directed air into the environment through the air outlet (110), and a water receiving tray (20) in fluid communication with the at least one conduit (10) and suitably mounted on top of the condensing unit (100), the water receiving tray (20) having a recessed channel (21) formed along the water receiving tray perimeter, wherein a plurality of spaced apart apertures (21*a*) is formed at the base of the recessed channel (21) situated above the evaporative pad (130).

2. The condensing unit (100) according to claim 1, wherein the chamber (200) is configured to receive the compressed refrigerant discharged from the compressor (140).

3. The condensing unit (100) according to claim 1, wherein the portion of the conduit (10*a*) that located within the chamber (200) is arranged in the shape of a coil.

4. The condensing unit (100) according to claim 1, wherein the condensing unit (100) is provided with a condensate line (90).

5. The condensing unit (100) according to claim 1, wherein the condensing unit (100) is provided with a disinfectant dispenser (600), wherein the disinfectant dispenser (600) is configured to dispense a controlled amount of disinfectant into the water reservoir (150).

6. The condensing unit (100) according to claim 1, wherein the condensing unit (100) is provided with a spray dispenser (900), wherein the spray dispenser (900) is configured to dispense a predetermined amount of disinfection aerosol into the surrounding area.

7. The condensing unit (100) according to claim 1, wherein the condensing unit (100) is further provided with a reversing valve (80) operatively connected to the refrigerant lines (700).

8. The condensing unit (100) according to claim 1, wherein the at least one evaporative pad (130) is preferably disposed above the water reservoir (150).

9. The condensing unit (100) according to claim 1, wherein the at least one evaporative pad (130) is preferably honeycomb cooling pad.

10. The condensing unit (100) according to claim 1, wherein excessive water in the at least one evaporative pad (130) is cascaded back into the water reservoir (150) of the condensing unit (100).

11. The condensing unit (100) according to claim 1, wherein the water reservoir (150) is provided with a float valve (153) connected to a water inlet (151).

12. The condensing unit (100) according to claim 1, wherein the water reservoir (150) is provided with a drain pipe (155) located proximate the bottom of the water reservoir (150).

13. The condensing unit (100) according to claim 1, wherein the water reservoir (150) is provided with an overflow pipe (157) located proximate the top of the water reservoir (150).

14. The condensing unit (100) according to claim 1, wherein the condensing unit (100) is further provided with a plurality of wheels mounted on a base surface of the condensing unit (100).

15. A condensing unit (100) adapted for use in heating, ventilation and air conditioning (HVAC) and refrigeration systems (1), wherein the condensing unit (100) comprises:

a compressor (140) operatively connected to a chamber (200), an expansion valve (500) and an evaporator coil (310) through a plurality of refrigerant lines (700);

a water pump (160) configured to deliver and supply water contained in a water reservoir (150) to at least one evaporative pad (130) through at least one conduit (10), wherein a portion of the conduit (10*a*) extends within the chamber (200);

a centrifugal fan (170) positioned proximate an air outlet (110), wherein the centrifugal fan (170) is configured to draw ambient air through the at least one evaporative pad (130) from at least one porous side wall (120) and directed air into the environment through the air outlet (110); and a trough (30), wherein the trough (30) is in fluid communication with the at least one conduit (10) and is suitably positioned above the evaporative pad (130).

16. The condensing unit (100) according to claim 15, wherein the trough (30) is provided with a plurality of spaced apart indentations (31*a*) formed on at least one side wall (31) of the trough (30).

17. The condensing unit (100) according to claim 15, wherein the trough (30) is provided with a plurality of spaced apart protruding lips (31*b*) formed on at least one side wall (31) of the trough (30).

* * * * *